US012180642B2

(12) United States Patent
Kelton et al.

(10) Patent No.: US 12,180,642 B2
(45) Date of Patent: Dec. 31, 2024

(54) PORTABLE AND MANUAL CLOTHES WRINGING SYSTEM

(71) Applicant: Eve Street Designs Pty Ltd., Queensland (AU)

(72) Inventors: Carrie Anne Kelton, Queensland (AU); Kenneth James Bingham, Queensland (AU)

( * ) Notice: Subject to any disclaimer, the term of this patent is extended or adjusted under 35 U.S.C. 154(b) by 0 days.

(21) Appl. No.: 18/802,975

(22) Filed: Aug. 13, 2024

(65) Prior Publication Data

US 2024/0401261 A1 Dec. 5, 2024

Related U.S. Application Data

(63) Continuation of application No. PCT/IB2024/053066, filed on Mar. 28, 2024.

(60) Provisional application No. 63/457,080, filed on Apr. 4, 2023.

(51) Int. Cl.

| | |
|---|---|
| ***D06F 51/02*** | (2006.01) |
| ***D03D 15/283*** | (2021.01) |
| ***D03D 15/33*** | (2021.01) |

(52) U.S. Cl.

CPC ..... *D06F 51/02* (2013.01); *D03D 15/283* (2021.01); *D03D 15/33* (2021.01); *D10B 2331/02* (2013.01); *D10B 2331/04* (2013.01); *D10B 2503/00* (2013.01)

(58) Field of Classification Search

CPC ..... D06F 51/02; D06F 29/02; D03D 15/283; D03D 15/33; D10B 2331/02; D10B 2331/04; D10B 2503/00

USPC ..... 34/398, 399, 400, 70; 68/243, 241

See application file for complete search history.

(56) References Cited

U.S. PATENT DOCUMENTS

| | | | | |
|---|---|---|---|---|
| 237,695 A * | 2/1881 | Pitcher | ..... | D06F 5/04 68/243 |
| 8,616,123 B2 * | 12/2013 | Sheena | ..... | B30B 9/26 100/297 |

FOREIGN PATENT DOCUMENTS

| | | | | |
|---|---|---|---|---|
| CN | 202482655 U | 10/2012 | | |
| CN | 106917242 A | 7/2017 | | |
| CN | 217203264 U | 8/2022 | | |
| JP | 2006311987 A | 11/2006 | | |
| JP | 2022082141 A | 6/2022 | | |
| WO | WO-2015132576 A1 * | 9/2015 | ..... | D06F 95/008 |

OTHER PUBLICATIONS

KIPO, International Search Report, PCT/IB24/53066, Jul. 8, 2024.
KIPO, Written Opinion Of The International Search Authority, Jul. 8, 2024.

* cited by examiner

*Primary Examiner* — John P McCormack

(57) ABSTRACT

A portable and manual clothes wringing system utilizes a wringer roll apparatus configured to retain wet clothes in a rolled up wringer fabric and has loops extending from the ends to receive rods for twisting and wringing water from wet clothes. The wringer roll apparatus enables a manual method of wringing water from clothes by twisting a first end rod extended through the first end loops with respect to the second end rod configured through the second end loops. The wringer fabric may be a microcloth made of microfibers. The wet clothes may contact the inside and outside surface of the wringer fabric when rolled in the wringer roll to more effectively wring water from the wet clothes.

20 Claims, 8 Drawing Sheets

PORTABLE AND MANUAL CLOTHES WRINGING SYSTEM

CROSS REFERENCE TO RELATED APPLICATIONS

This application is a continuation of international patent application No. PCT/IB2024/053066, filed on Mar. 28, 2024, which claims the benefit of priority to U.S. patent application No. 63/457,080, filed on Apr. 4, 2023; the entirety of both prior applications are hereby incorporated by reference herein.

BACKGROUND OF THE INVENTION

Field of the Invention

The invention relates to a portable and manual clothes wringing system that utilizes a wringer roll apparatus configured to retain wet clothes in a rolled up wringer fabric and having loops extending from the ends to receive rods for twisting and wringing water from the wet clothes.

Background

There are many situations where a person may want to dry or wring out their clothes but do not have access to a clothes dryer, such as when they are camping, or before heading home from the beach or pool. Backpackers and campers often wash their clothes and then hand wring them out and lay them out on a rock or hang them from tree to dry in the sun. Hand wringing has limited effectiveness and the clothes may stay wet which increases their weight, which is not desirable for backpacking. Also, when leaving the beach or a pool, people often change out of their wet bathing suits but they remain very wet which is not desirable.

SUMMARY OF THE INVENTION

The invention is directed to a portable and manual clothes wringing system that utilizes a wringer roll apparatus configured to retain wet clothes in a rolled up wringer fabric and having loops extending from the ends to receive rods for twisting and wringing water from wet clothes. The invention is further to a method of wringing water from clothes using the wringer roll apparatus.

The wringer roll apparatus has a wringer fabric that is configured to be rolled around the garments to be wrung out. The wringer fabric may be a microcloth made of microfibers that may be a synthetic material such as, but not limited to, polyesters, polyamides, polypropylene, and combinations thereof. The microfibers may be less than about 1 denier and have a diameter of less than about 10 micrometers. The microfibers of microcloths may have ends that extend away from the microcloth. The ends of the microfibers may be split to form split ends of the microfibers. The split ends of each end of each microfiber may extend in a different direction. The split ends of the microfibers allow microcloth to attract moisture, and thereby allow microcloth to dry wet articles with which they come in contact.

The microcloth may be a suede microcloth or microsuede that includes a particular arrangement of microfiber. Microsuede is a manufactured fabric that may include polyester microfibers. Microsuede is cheaper than genuine suede and is more resistant to wear and stains. Microsuede is extremely durable and long lasting and is lightweight, highly absorbent and quick drying. Microsuede is soft like natural suede leather, resistant to wear, friendly to pets, mostly impervious to stains, easy to care for and inexpensive.

The microfibers of the wringer fabric may be made of polyester, polyamide, or a combination thereof. The wringer fabric may be about 75% or more polyamide and about 25% polyester or less, or any combination of percentages of polyamide and polyester between and including the percentages provided. For example, anywhere from 75% to 85% of the microfibers of the wringer fabric by weight may be polyamide, and 15% to 25% of the microfibers of the wringer fabric by weight may be polyester. Polyester and polyamide are chosen as materials for the microfibers of the wringer fabric since these two materials, when used in microfibers that are formed into a microcloth, allow for a microcloth that is porous and dries quickly. Polyester allows the wringer fabric to retain a structure such as a rectangle. Polyamide fibers are effective to enable the microcloth to absorb more water.

The wringer fabric extends from a first end to a second end, and has a length axis extending from the first end to the second end. The wringer fabric has a first side, a second side, an inside surface, and an outside surface. The wringer fabric may consist of a single layer of fabric which may be a microcloth, such as a microsuede. The wringer fabric may be a rectangle in shape, wherein the first side and second side are substantially parallel to each other and the first end and second end are substantially perpendicular to the sides and substantially parallel with each other. "Substantially parallel" means parallel within about 10 degrees of parallel. "Substantially perpendicular" means perpendicular within about 10 degrees of perpendicular.

The wring fabric may have a length from a first end to a second end of about 0.5 m or more, about 0.75 m or more, about 1 m or more, about 1.25 m or more, about 1.5 m or more and any range between and including the length values provided. The width of the wringer fabric from a first side to a second side may be about 0.5 m or more, about 0.75 m or more, about 1 m or more, about 1.25 m or more, about 1.5 m or more and any range between and including the width values provided. The length may be greater than the width, such as about 1.25 times the width or more, or about 1.5 times the width or more, or even about 2.0 times the width or more. The length may be such that a single person can operate the wringer roll apparatus by standing on an end rod and twisting, by hand, the opposing end rod on the opposing end of the wringer roll.

The wringer roll apparatus may have first end loops extending from the first end and second end loops extending from the second end. Each of the first end and second end may have a plurality of loops such as two or more, three or more, four or more, five or more, six or more, and any range between and including the values provided. A greater number of first end loops and second end loops may enable more uniform distribution of forces during the wringing process. A fewer number of first end loops and second end loops allows for the wringer apparatus to be easier to operate and use as there would be less loops to extend the end rods therethrough and would also make manufacturing less complicated and lower cost.

Wet clothes may be configured to contact the inside surface of the wringer fabric. "Wet clothes" means that the clothes contain a concentration by weight of water that is greater than the weight of the clothes when dry. Dry clothes may be defined as clothes that have less than 5% moisture by weight. A wet article of clothing may have about 10% water by weight or more, about 20% water by weight or more, about 50% by weight of water or more, or as described above about 100% water by weight or more. For example, in an exemplary embodiment, a shirt that weighs 90 g may be considered "wet" if at least 90 g of water is held within the fabric of the shirt, meaning that the 90 g shirt weighs at least 180 g when wet. An article of clothing may be saturated with water, meaning that the fabric of the article of clothing is holding substantially a maximum amount of water for that fabric, or within about 10% of the maximum. For example, cotton may hold up to 25 times its own weight in water. Therefore, a 90 g cotton shirt may hold a maximum of 2.25 kg of water, making the total weight of the saturated shirt 2.34 kg. Saturated is a subset of wet. Therefore, an article of clothing that is saturated may also be considered wet. However, an article of clothing that is considered wet may not be considered saturated unless that article of clothing is holding substantially the maximum amount of water as described herein.

The wringer roll apparatus may be configured to roll around wet clothes to create a wringer roll. The wet clothes may be configured on the wringer fabric and then rolled up within the wringer fabric to form a wringer roll for squeezing or wringing water from the clothes. The clothes may be positioned on the wringer roll fabric such that they create a uniform distribution along the length of the wringer roll when rolled up. Uniformly distributing the clothes may prevent bulging of the clothes in one location and more effectively wring water from the clothes when the wringer roll is twisted. The wringer fabric may be rolled from the first side to the second side to form the wringer roll.

A first end rod may be configured through the first end loops and a second end rod may then be configured through the second end loops of the wringer roll to produce the wringer roll apparatus. The first end rod and second end rod may be solid rods or may be tubes or hollow. An exemplary end rod has a circular cross section, having a smooth rounded exterior that will facilitate sliding the end rod through the end loops. The first end rod and second end rods may be made out of metal or a plastic, such as a rigid plastic including acrylic, polyester, or polyvinyl chloride (PVC). Polyvinyl chloride tubing is commonly used for plumbing applications and is rigid and lightweight. The end rods may have an outside diameter of about 10 mm or more, about 14 mm or more, about 20 mm or more, about 30 mm or more and any range between and including the values provided. The length of the end rod may be about 0.25 m or more, about 0.5 m or more, about 0.75 m or more, about 1 m or more and any range between and including the length values provided. A longer end rod will make it easier to twist as the torque arm is longer, however, if too long, the length may make twisting or rotation difficult, especially for single person operation.

First end sleeves may be configured over ends of the first end rod to provide handles for someone to manually hold onto when twisting the first end rod. Second end sleeves may be configured over ends of the second end rod to provide handles for someone to manually hold onto when twisting the second end rod. The first end sleeves and second end sleeves may be made of a plastic or elastomeric material such as silicone or urethane to provide some comfort during the wringing process and to provide a more secure gripping surface. The first end sleeves and second end sleeves, or one of them may be detachably attachable to the respective end rod to enable easier insertion of the end rods through the respective end rod sleeves. The end rod sleeves may be larger in diameter than the end rod and removing one of them may facilitate threading this end, with the end rod sleeve removed, through the end rod sleeves.

The wringer roll apparatus may then be twisted by twisting the first end rod about the length axis while retaining the second end rod in a fixed position or by turning the second end rod in an opposing direction to the first end rod. This wringing process wrings out water from the wet clothes and water from the wet clothes will flow through the wringer fabric and out of the wringer fabric. The wringer roll apparatus may be operated by a single person, wherein a first end is retained in a fixed position by standing on the first end rod and twisting the second end rod that is configured through the second end loops on the second end of the wringer roll. In this method, the wringer roll extends vertically up in front of a person. Also, the wringer roll apparatus may be operated by two people, wherein a first person twists a first end rod extending through the first end loops of a wringer roll and wherein a second person holds onto the second end rod. The second person may secure the second end rod and prevent it from twisting due to the force created by the first person, or may rotate the second end rod in a direction opposite to the rotational direction of the first end rod rotation. This counter rotating end twisting may provide increased force and more effectively wring water from the clothes within the wringer roll.

Water is squeezed out of the clothes during the wringing process and may absorb into the wringer fabric and then drip or flow out of the wringer fabric to dry the clothes. Also, water may be absorbed by the wringer fabric to effectively dry the clothes.

The clothes may be considered dried clothes when an effective amount of water is removed from the clothes, such as about 30% or more, about 50% or more, about 75% or more, about 80% or more, or even about 90% or more. Some types of fabrics may more readily enable water to be wrung from them and removed using the wringer roll apparatus.

When the wringer roll apparatus is twisted the inside surface and outside surface of the wringer fabric press against the wet clothes to squeeze and compress water from the clothes. The split ends of the microfibers of the wringer fabric may attract water from the wet clothes to enable the water to flow through the wringer fabric, where it is expelled from the wringer roll. When the wringer roll apparatus is twisted, the microfibers of the wringer fabric may be configured closer together, and may exert forces on each other that push the water that was absorbed by the wringer fabric out of the wringer fabric. In this manner, the wringer roll apparatus, may "wring" water from clothes by exerting a physical force to force water out of the fabric of the clothes, attracting the water using microfibers of the microcloth, and exerting forces on the microfibers of the microcloth to force the water out of the microcloth and out of the wringer apparatus, thereby removing water from the clothes and expelling the water outside of the wringer roll.

The wringer roll apparatus may be capable of drying a variety of fabrics. The chart below shows a study that was performed on the wringer roll apparatus wherein the wringer roll apparatus and a washing machine powered by electricity and using a spin cycle were each used to dry various clothing items. The clothing items were saturated with water prior to being dried by the wringer roll apparatus and the washing machine. The clothing items were each dried by the wringer roll apparatus and the washing machine separately, allowing for a comparison in the drying ability of the wringer roll apparatus and the washing machine. As shown in the chart, the washing machine is more effective than the wringer roll apparatus at drying clothes, with the exception of drying 100% cotton towels. However, the wringer roll apparatus does dry every clothing item of the study by removing at least 30% of the water weight added to saturated clothing items.

The wringer fabric of the wringer roll used in this study was a micro-cloth made of microfiber having an 80% polyester and 20% polyamide blend. The washing machine used was a Bubble Wash 8.5 kg, Digital Inverter Technology, Model #WW85H5400EW.

| Clothing Item | 100% Cotton Towels | Cotton/ Polyester Qu Sheet | Lycra Swim Shirts | Bamboo Towel | Polyester Dressing Gown | Denim Jeans | Microfiber Towels |
|---|---|---|---|---|---|---|---|
| Percentage of water weight removed by wringer roll apparatus | 60% | 49% | 66% | 44% | 74% | 38% | 50% |
| Percentage of water weight removed by washing machine | 77% | 78% | 93% | 77% | 96% | 76% | 85% |

The wringer roll apparatus has a number of advantages over a washing machine. The wringer roll apparatus is more cost-effective that a washing machine. Also, the wringer roll apparatus does not require an electrical power source and is manually operated. The wringer roll apparatus is portable and can be easily taken with a person on a trip, to a pool or body or water or into remote areas such as when camping or backpacking. A portable wringer roll apparatus is portable in that it can be easily carried by a single person and may weigh about 10 kg or less, about 8 kg or less, about 5 kg or less or even 3 kg or less, and any range between and including the weights provided.

The invention is further directed to a method of wringing water from wet clothes. The clothes wringing system described herein may be provided. Wet clothes may be provided, and may be configured on the wringer fabric. The wet clothes may be configured on the inside surface of the wringer fabric. The clothes may be uniformly distributed along the wringer fabric, wherein the total thickness of the combined clothes may be substantially uniform across the area of the wringer fabric.

The wringer fabric may be rolled from the first side to the second side to produce a wringer roll and to retain the clothes within the wringer roll. The clothes may contact both the inside surface and the outside surface of the wringer fabric when retained within the wringer roll. The first end rod may be configured through the first end loops, and the second end rod may be configured through the second end loops.

The second end rod may be retained in a stationary position, and the first end rod may be twisted relative to the second end rod. The first end rod may be twisted about the length axis. The first end rod may be twisted one or more revolutions about the length axis, such as about 3 or more rotations about five or more rotations. The more rotations increases the compression force on the wringer fabric and the wet clothes retained therein. The twisting of the first end rod relative to the second end rod may cause the wringer roll to twist about the length axis, thereby wringing water from the wet clothes, thereby drying the clothes. The second end rod may be retained in a stationary position by a first user standing on the second end rod. The first end rod may be twisted by hand by the first user, while the first user stands on the second end rod. In this way, the wringer roll apparatus may be operated by a single person to wring water out of wet clothes. Alternatively, the first user may twist the first end rod by hand while a second user holds the second end rod to retain the second end rod in a stationary position. Alternatively, the second user may twist the second end rod relative to the first end rod in a direction opposite to the direction in which the first end rod is twisted.

The first end rod may then be twisted in an opposite direction relative to the second end rod to untwist the wringer roll. The wringer roll may be unrolled by rolling the first side away from the second side to release the dry clothes from the wringer roll.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
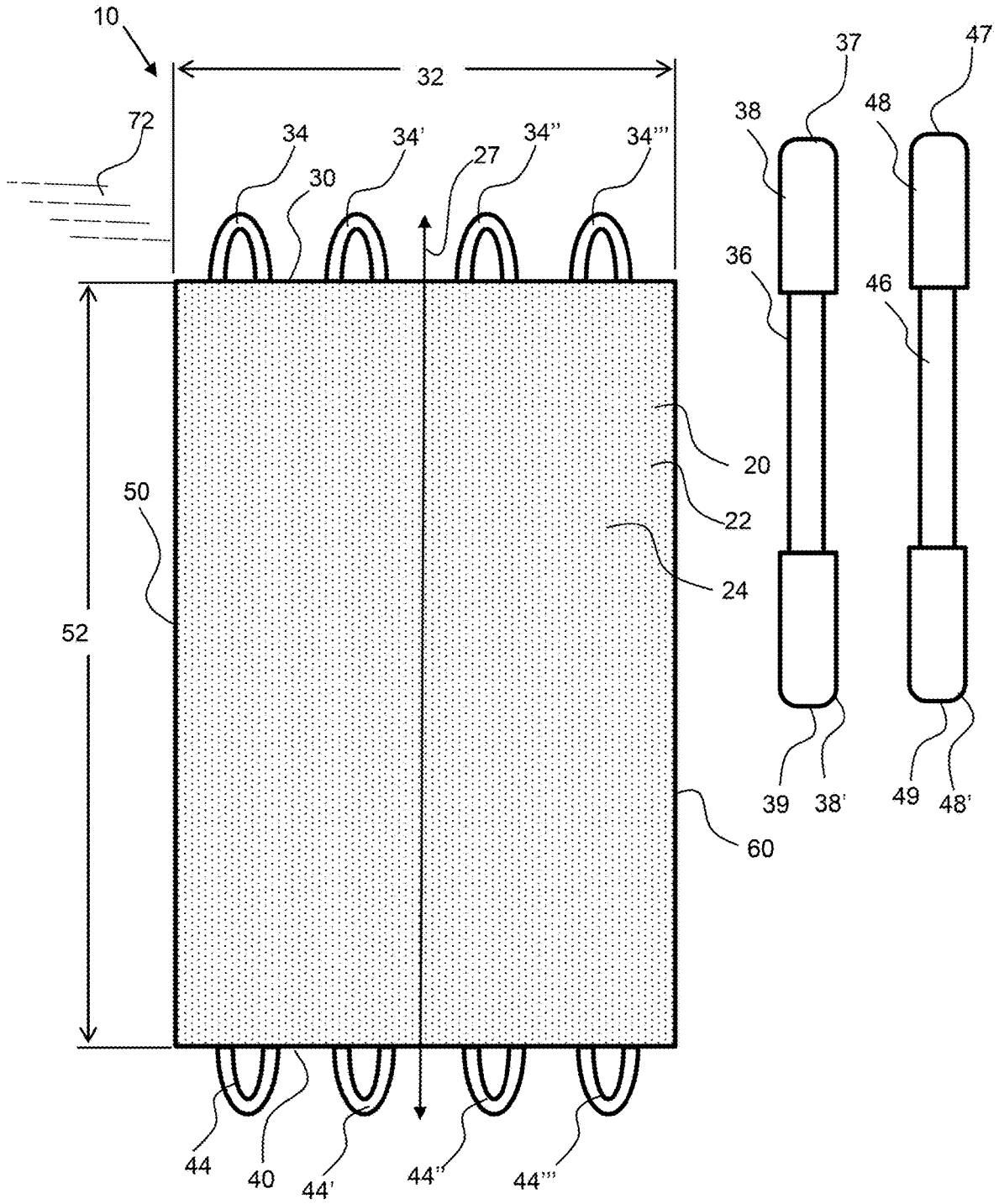
FIG. 1 shows a top view of a clothes wringing system in an unrolled state on a ground surface and comprising a wringer roll apparatus having a wringing fabric with end loops extended from a first and second end, and end rods configured to extend through the end loops to enable twisting the wringer roll apparatus to wring water from clothes configured therein.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations, and improvements of the described embodiments, will occur to those skilled in the art and all such alternate embodiments, combinations, modifications, improvements are within the scope of the present invention.

As shown in FIG. 1, an exemplary clothes wringing system 10 has a wringer roll apparatus 20 that includes a wringer fabric 22 and first end loops 34, 34', 34", 34'" extending from the first end 30 of the wringer fabric and second end loops, 44, 44', 44", 44'" extending from the second end 40 of the wringer fabric. The clothes wringing system also includes a first end rod 36 and a second end rod 46, wherein the first end rod is configured for insertion through the first end loops and the second end rod is configured for insertion through the second end loops to enable the first end rod to be twisted to wring water from clothes retained in the wringer fabric when in a rolled up configuration. The first and/or second end rod may have sleeves configured over the ends that may act as handles or may provide increased retention for retain the rod in place by standing thereon.

The wringer fabric 22 has a length 52 from the first end 30 to the second end 40, and the first end may be configured substantially parallel to second end 40, or within about 20 degrees of parallel and preferably within about 10 degrees of parallel. The wringer fabric 22 has a width 32 from a first side 50 to a second side 60, and the first side and second sides may be substantially parallel, or within about 20 degrees of parallel and preferably within about 10 degrees of parallel. The sides may be substantially perpendicular to the ends, again within about 20 degrees of perpendicular and preferably within about 10 degrees of perpendicular. The wringer fabric may be rectangular in shape, as shown to enable uniform rolling thickness of the wringer fabric when rolled from the first side 50 to the second side 60. As shown in FIG. 1, the wringer roll apparatus 20 is a rectangle, and therefore the first end and second end are substantially equal in length and the first side and second side are substantially equal in length.

A length axis 27 extends from the second end 40 to the first end 30, parallel to the first side 50 and the second side 60. The wringer roll apparatus has an inside surface 24 and an outside surface (not shown in FIG. 1), opposite the inside surface.

As shown in FIG. 1, the first end rod 36 has first end rod sleeves 38, 38' on the first end 37 and the second end 39 of the first end rod, respectively. Likewise, the second end rod 46 has second end rod sleeves 48, 48' on the first end 47 and second end 49 of the second end rod 46, respectively.

Figure 2:
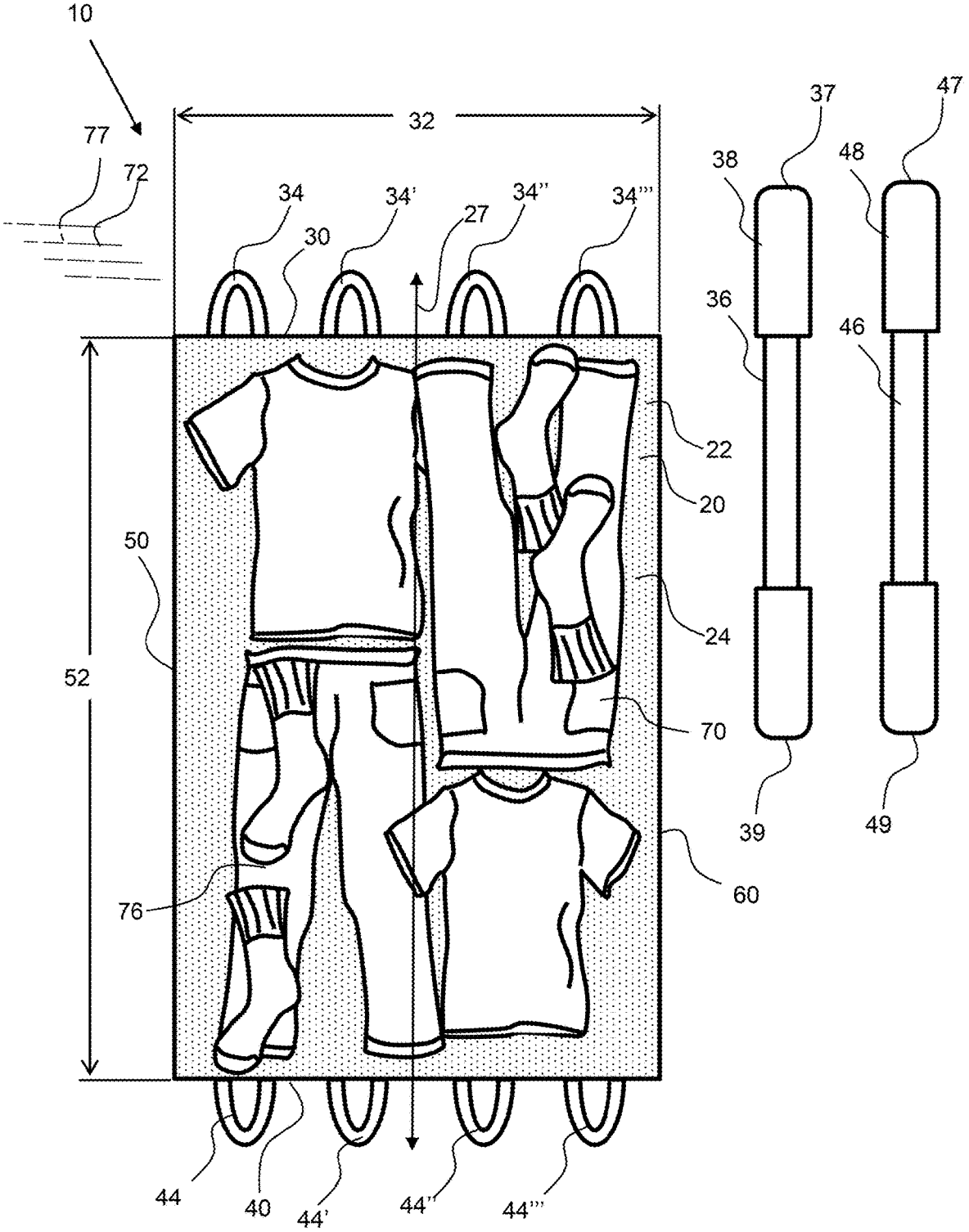
FIG. 2 shows a top view of a clothes wringing system of FIG. 1 in an unrolled state with clothes laying thereon the wringer fabric portion of the wringer roll apparatus.

As shown in FIG. 2, the clothes wringing system 10 is configured on a flat surface 77, or ground surface 72, such as a floor, porch, deck, patio, or the like. The clothes wringing system 10 is configured on the flat surface 77 or ground surface 72 whereby the outside surface (not shown in FIG. 2) contacts the ground surface 72 and whereby the inside surface 24 faces away from the ground surface 72. Wet clothes 70 are configured on the inside surface and are spread out in a uniform distribution to avoid large bulging of the wringer roll. As shown a few shirts, a few pairs of pants and socks are laid out flat on the inside surface 24 of the wringer fabric.

Figure 3:
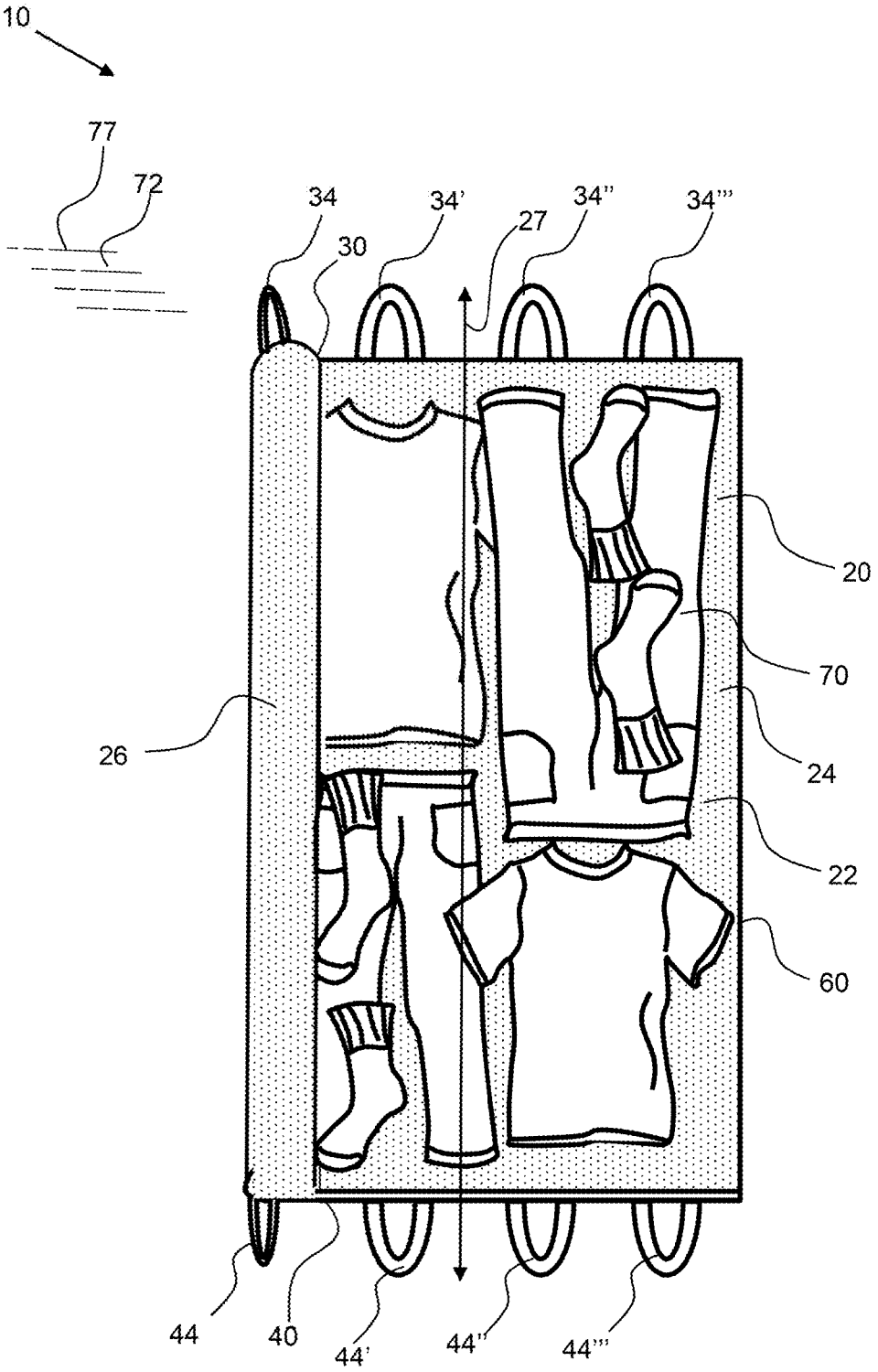
FIG. 3 shows a top view of the clothes wringing system of FIG. 2 being rolled from a first side to a second side.

As shown in FIG. 3, the wringing roll apparatus 20 is being rolled from the first side 50 to the second side 60 along the flat surface 77. The wringing roll apparatus is rolled whereby the wet clothes 70 contact the inside surface 24 and the outside surface 26 of the wringer fabric 22, which increases absorption of water into the wringer fabric and improves wringing effectiveness.

Figure 4:
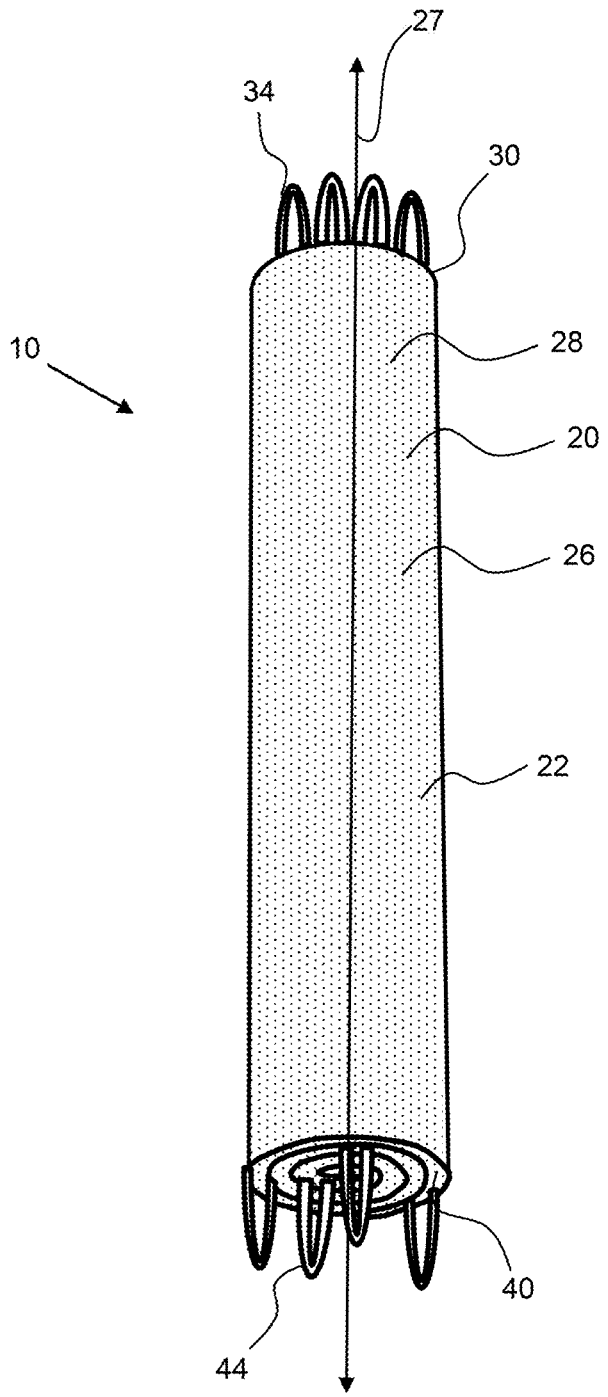
FIG. 4 shows a perspective view of the clothes wringing system of FIGS. 2 and 3 now rolled into a wringer roll, having the clothes configured within the wringer roll.

As shown in FIG. 4, the wet clothes (not shown in FIG. 4) are completely enclosed within the wringer roll 28. As shown, the wringer roll 28 is rolled into a jelly roll. In this configuration, the outside surface 26 is visible, but the inside surface is not visible. The length of the wringer roll extends along the length axis 27 of the wringer roll apparatus.

Figure 5:
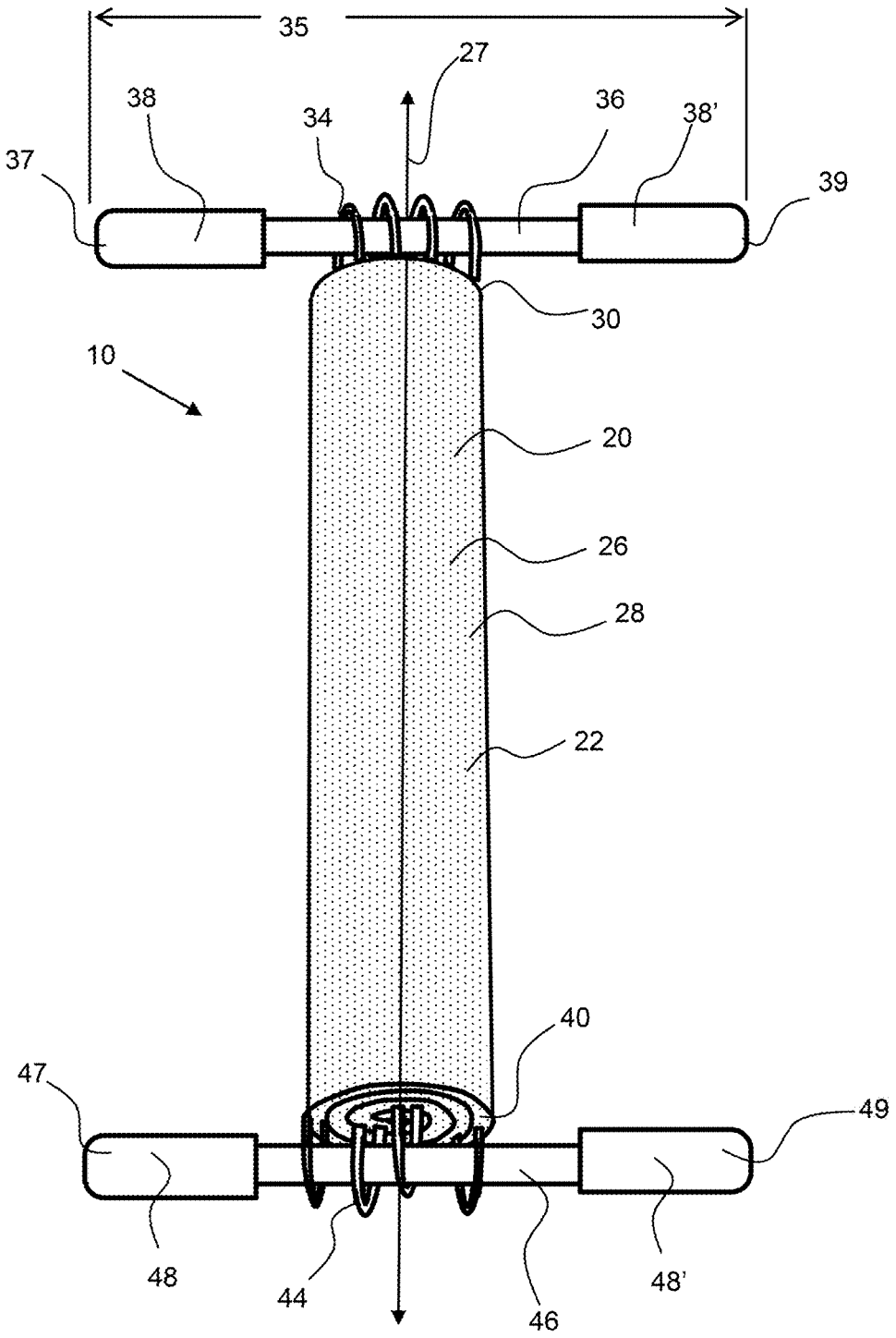
FIG. 5 shows a perspective view of the clothes wringing system of FIGS. 2 to 4 in a rolled state with the first end rod configured through the first end loops extending from the first end of the wringer roll apparatus and the second end rod configured through the second end loops extending from the second end of the wringer roll apparatus.

As shown in FIG. 5, a first end rod 36 is configured through the first end loops 34 and a second end rod 46 is configured through the second end loops 44. First end rod sleeves 38, 38' are configured over the first end 37 and second end 39 of the first end rod 36, respectively. Second end rod sleeves 48, 48' are configured over the first end 47 and second end 49 of the second end rod 46, respectively. The wringer roll apparatus 20 is now configured to wring water from the clothes retained within the wringer roll 28. As shown in FIG. 5 the first end rod has an end rod length 35. The first end rod and second end rods may have the same length.

Figure 6:
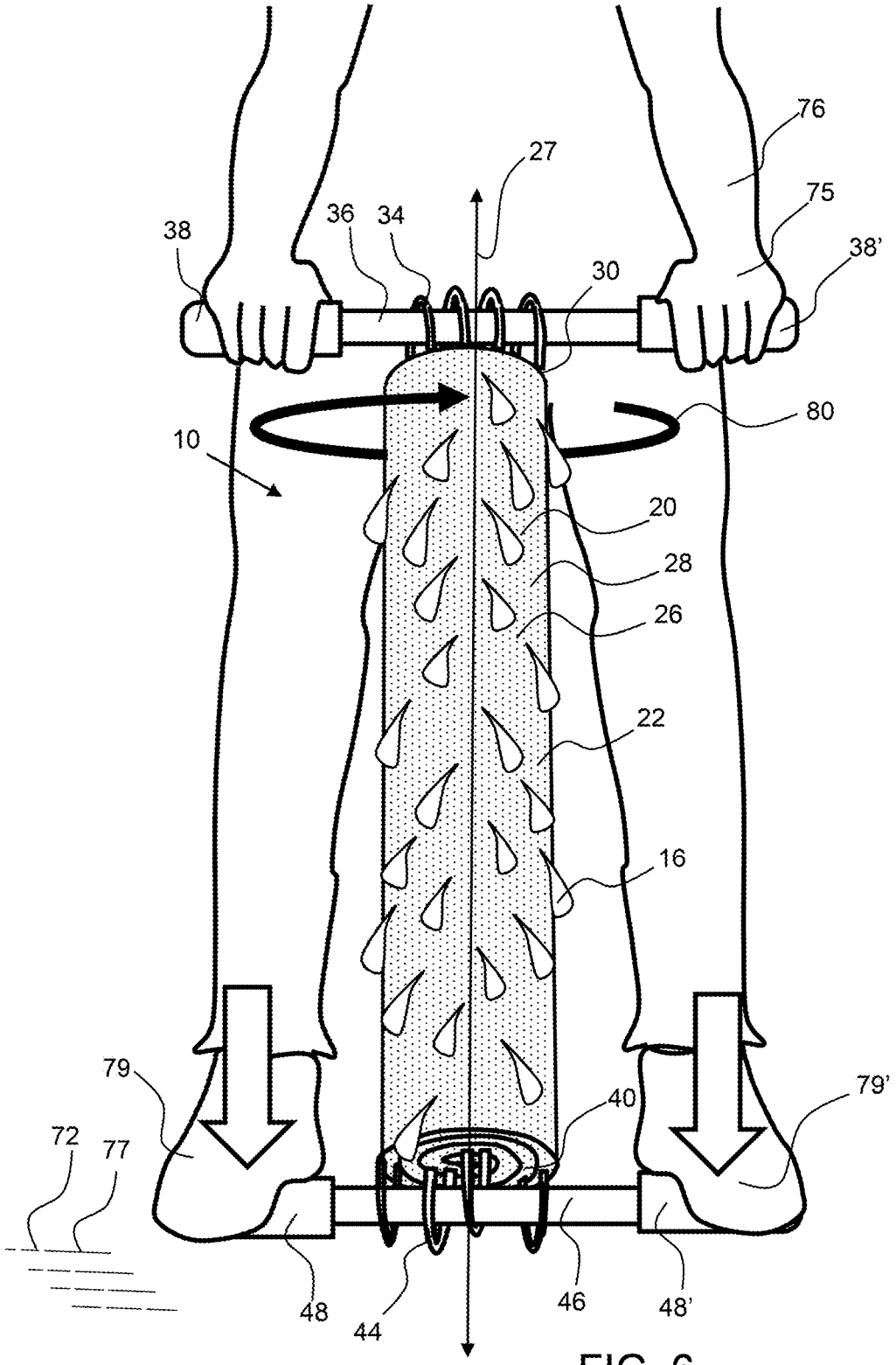
FIG. 6 shows a front perspective view of the clothes wringing system being used to wring water from the clothes configured in the wringer roll shown in FIG. 5, wherein the first end rod is being twisted by hand while the second end rod is being retained by the person standing on the second end rod; single person operation.

As shown in FIG. 6, the wringer roll apparatus 20 of the clothes wringing system 10 is being used to wring water 16 from the wet clothes retained within the wringer roll 28. The user 76 is gripping, by hand 75, the first end rod 36 by the first end rod sleeves 38, 38' and is twisting the wringer roll 28 in a rotational direction 80, as indicated by the bold curved arrow. The rotation is generally about the length axis 27 of the wringer fabric 22 or wringer roll 28. The user 76 is using their feet 79, 79' to retain the second end rod 46. The user is standing on each of the extended ends of the second end rod. A user's first foot 79 is standing and pressing down on the first end of the second end rod 46 and the user's second foot 79' is standing and pressing down on the second end of the second end rod, as indicated by the bold arrows. In this configuration, the wringer roll 28 extends vertically up from the ground surface 72 and is twisted to produce a pressure on the wet clothes to force the water out of the wet clothes. The wringing fabric wicks the water away from the wet clothes during this process and the water 16 drains down the outside of the wringer roll 28 and down onto the ground surface 72.

Figure 7:
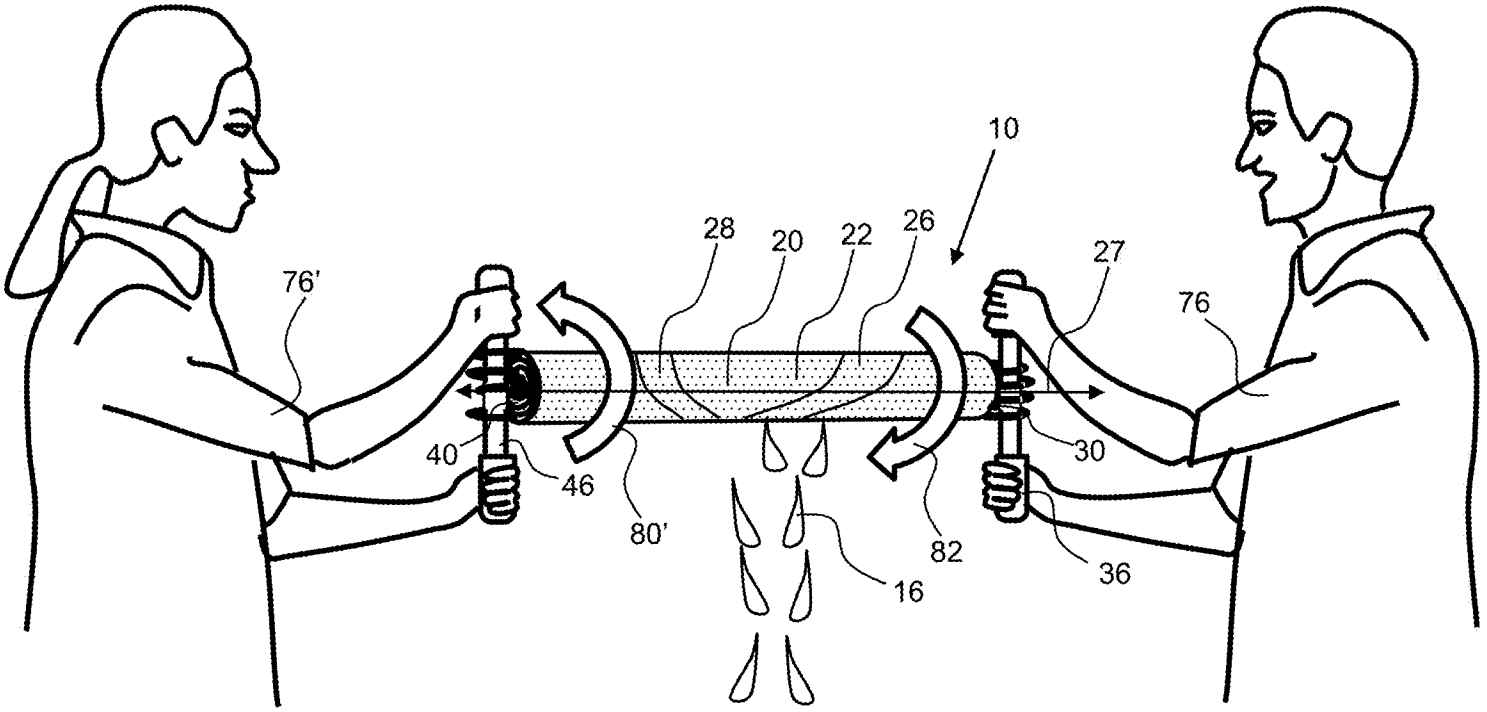
FIG. 7 shows a perspective view of two people wringing water from wet clothes using an exemplary wringer roll apparatus by twisting the end rods in opposing directions.

As shown in FIG. 7 a wringer roll apparatus 20 is being manually twisted by two user 76, 76', or people. A first user 76 is holding the first end rod 36 and is twisting the wringer roll 28 in a first rotational direction 80 and the second user 76' is holding the second end rod 46 and is twisting the wringer roll in a second rotational direction 82, opposite the first rotational direction 80. Water 16 is being wrung out of the wet clothes retained within the wringer roll 28.

Figure 8:
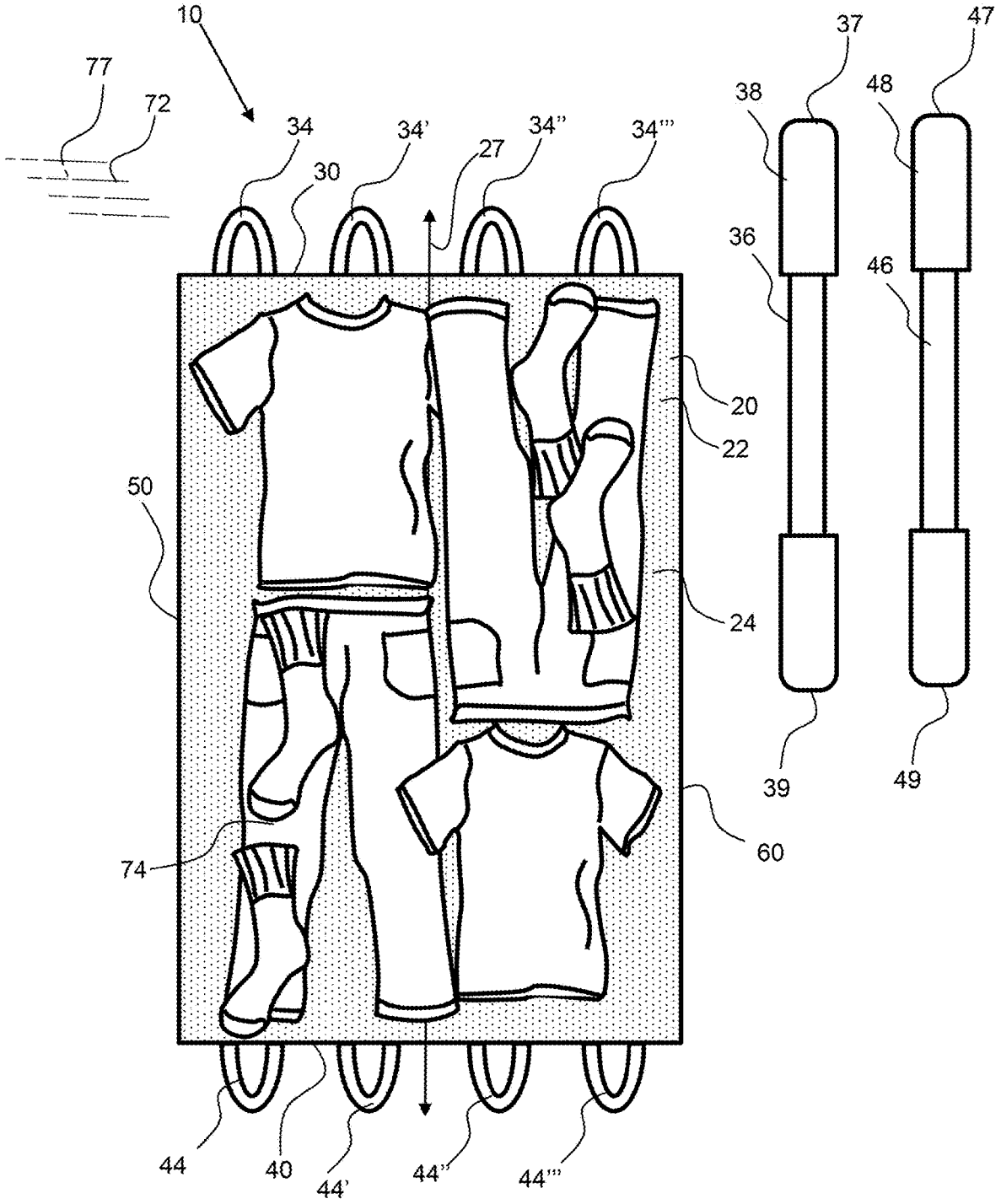
FIG. 8 shows a top view of the wringer roll apparatus unrolled after wringing water from the wet clothes to produce dried clothes.

After an effective amount of wringing by twisting the wringing roll, the wringing roll can be unrolled as shown in FIG. 8. The first end rod 36 and second end rods 46 may be pulled out of the first end loops 34 and second end loops 44, respectively. As shown in FIG. 8, the dried clothes 74 are laying on the inside surface 24 of the wringer fabric 22.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A clothes wringing system comprising:
a wringer roll apparatus comprising:
a wringer roll comprising:
a wringer fabric comprising:
a first end;
a second end;
a length axis extending from the first end to the second end;
a first side;
a second side;
an inside surface; and
an outside surface;
two or more first end loops extending from the first end;
two or more second end loops extending from the second end;
wherein wet clothes are configured to be retained within the wringer roll on the wringer fabric rolled from said first side to said second side;
a first end rod configured through the first end loops;
a second end rod configured through the second end loops; and
wherein the wringing roll is configured to be twisted by hand by twisting the first end rod with respect to the second end rod to wring water from the wet clothes.

2. The clothes wringing system of claim 1, wherein the wringer fabric is microcloth.

3. The clothes wringing system of claim 2, wherein the wringer roll apparatus is made of woven fibers,
wherein the woven fibers have diameters of 10 micrometers or less.

4. The clothes wringing system of claim 3, wherein the woven fibers comprise polyester.

5. The clothes wringing system of claim 3, wherein the woven fibers comprise polyamide.

6. The clothes wringing system of claim 1, wherein the wringer fabric is rectangular in shape;
wherein the first end is substantially parallel within 20 degrees to the second end; and
wherein the first side is substantially parallel within 20 degrees to the second side.

7. The clothes wringing system of claim 1, comprising four or more first end loops and four or more second end loops.

8. The clothes wringing system of claim 1, wherein the first end rod has first end sleeves.

9. The clothes wringing system of claim 1, wherein the second end rod has second end sleeves.

10. The clothes wringing system of claim 1, wherein the wringer fabric is a suede microcloth.

11. A method of wringing water from wet clothes comprising:
providing the clothes wringing system of claim 1;
providing said wet clothes;
configuring the wet clothes on the wringer fabric;
rolling the wringer fabric and clothes therein from said first side to the second side to produce said wringer roll;
wherein the wet clothes contact the inside surface and the outside surface of the wringer fabric;
configuring the first end rod through the first end loops;
configuring the second end rod through the second end loops;
twisting the first end rod with respect to the second end rod to twist the wringer roll to wring water from the wet clothes;
unrolling the wringer roll and removing dried clothes.

12. The method of claim 11, wherein the first end rod is twisted by hand.

13. The method of claim 12, wherein the second end rod is retained by standing on the second end rod.

14. The method of claim 12, wherein the first end rod is held and twisted by a first user and wherein the second end rod is held by a second user.

15. The method of claim 14, wherein the second end rod is twisted in an opposing direction to the first end by said second user.

16. The method of claim 11, wherein the wringer fabric is microcloth.

17. The method of claim 16, wherein the wringer roll apparatus is made of woven fibers,
wherein the woven fibers have diameters of 10 micrometers or less.

18. The method of claim 16, wherein the woven fibers comprise polyester.

19. The method of claim 16, wherein the woven fibers comprise polyamide.

20. The method of claim 11, wherein the wringer fabric is rectangular in shape;
wherein the first end is substantially parallel within 20 degrees to the second end; and
wherein the first side is substantially parallel within 20 degrees to the second side.

* * * * *